US005478312A

United States Patent [19]

Weissbuch

[11] Patent Number: 5,478,312

[45] Date of Patent: Dec. 26, 1995

[54] HAND HELD AQUATIC EXERCISING DEVICE

[76] Inventor: Sanford S. Weissbuch, 2276 S. Beverly Glen Blvd., Ste 202, Los Angeles, Calif. 90064

[21] Appl. No.: 116,861

[22] Filed: Sep. 2, 1993

[51] Int. Cl.[6] ..... A63B 31/08

[52] U.S. Cl. ..... 482/111; 482/55; 482/908; D21/236

[58] Field of Search ..... 482/44, 50, 55, 482/106, 107, 108, 111, 908, 904; D21/196, 197, 198, 236, 237; 441/56, 59, 60, 80, 129; 472/128, 129; 434/254; 4/255.05, 255.11; 440/101; 248/205.5, 205.6, 205.7, 206.1, 206.2, 206.3; 273/129, 344

[56] References Cited

U.S. PATENT DOCUMENTS

| | | | |
|---|---|---|---|
| D 169,246 | 4/1953 | Eisenberg | 482/24 |
| D 320,059 | 9/1991 | Bedortha et al. . | |
| 516,963 | 3/1894 | Bunsen | 441/56 |
| 675,314 | 5/1901 | Abenheim . | |
| 793,101 | 6/1905 | Schmidt | 482/108 |
| 1,090,004 | 3/1914 | Wyche | 441/56 |
| 2,825,069 | 3/1958 | Jorgensen et al. | 248/205.5 |
| 3,655,193 | 4/1972 | Jones | 273/DIG. 15 |
| 3,904,198 | 9/1975 | Jones | 482/106 |
| 3,942,790 | 3/1976 | Rice | 482/91 |
| 4,007,506 | 2/1977 | Rasmussen | 441/64 |
| 4,311,306 | 1/1982 | Solloway . | |
| 4,312,506 | 1/1982 | Brennan | 482/108 |
| 4,416,451 | 11/1983 | Solloway . | |
| 4,480,829 | 11/1984 | Yecaboski . | |
| 4,603,854 | 8/1986 | Krausz . | |
| 4,623,142 | 11/1986 | MacKechnie . | |
| 4,768,774 | 9/1988 | Beasley . | |
| 4,819,951 | 4/1989 | Solloway . | |
| 4,988,09*4 | 1/1991 | Beasley . | |
| 5,000,153 | 3/1991 | Zimmerman et al. | 273/129 R |
| 5,000,710 | 3/1991 | Bedortha et al. . | |
| 5,031,904 | 7/1991 | Solloway . | |
| 5,033,739 | 7/1991 | MacKechnie . | |
| 5,102,120 | 4/1992 | Linblad . | |

FOREIGN PATENT DOCUMENTS

| | | | |
|---|---|---|---|
| 0223926 | 6/1985 | Germany | 482/106 |
| 3696 | 2/1900 | United Kingdom | 482/106 |

*Primary Examiner*—Joe H. Cheng
*Assistant Examiner*—Jeanne M. Clark
*Attorney, Agent, or Firm*—Merchant, Gould, Smith, Edell, Welter & Schmidt

[57] ABSTRACT

A hand held aquatic exercising device includes a handle and relatively moveable hydroresistive elements at respective ends of the handle. The hydroresistive elements can be moved to different positions relative to a longitudinal axis through the handle. In another embodiment the hydroresistive elements are selectively removable from the handle. The hydroresistive elements can be assembled in different relative positions with the handle. The handle is selectively solid or hollow. The device thereby presents a resistance to the water that can be varied according to the desires of the user. The hydroresistive elements may be cup-like and may be flexible to facilitate reversal about their bases. A hand gripping element facilitates rotation of the handle about the longitudinal axis while the gripping element is held in the palm of a user and the device is moved through water.

11 Claims, 4 Drawing Sheets

HAND HELD AQUATIC EXERCISING DEVICE

BACKGROUND

Having an aquatic exercising device that can provide for adjustable resistance through water is highly desirable. This invention relates to a hand held aquatic exercising device.

In particular the device can be adjusted to provide for multidirectional varied resistance whereby the exercising effect for the user can be varied as desired.

Aquatic exercising is highly desirable for improving the muscular tone and cardiovascular system. Exercising in water is advantageous since the body is cool and movements are relatively smooth thereby minimizing the chance of injury due to jarring. Moreover, water increases the general resistance and effort needed to move in any direction.

Different hand devices are known for facilitating aquatic exercising. In the Applicant's experience such devices are relatively complex. They are difficult to adjust, relatively complex in construction and cumbersome for carrying, especially when not in use.

There is a need to have an aquatic hand held exercising device which minimizes the disadvantages of known devices.

SUMMARY

The present invention is directed to minimizing the disadvantages of known aquatic hand exercising devices.

According to the invention, there is provided a hand held aquatic exercising device. There is an elongated handle which has a first end and a second end. Two hydroresistive elements which preferably are essentially cup-shaped are operatively connected at each opposite end of the handle.

Each cup includes a radial axis extending from a base of the cup, and a transverse plane diametrically and transversely located over the rim of the cup. The handle provides a longitudinal axis.

The handle is preferably surrounded with a hand gripping element which facilitates rotation of the handle about the longitudinal axis. This facilitates rotation of the device about the longitudinal axis as the device is moved through water with the gripping element held in the palm of the hand. Selectively the hand gripping elements can also be locked in a fixed position relative to the handle.

In one form of the invention, the cup is moveable relative to the longitudinal axis and the transverse axis thereby being able to adopt multiple selected different positions relative to the elongated handle.

A crossbar extends over the rim of the cup, the crossbar including remote ends. The remote ends engage with ends of a stirrup. A stirrup is provided at each end of the handle. The stirrup is connected substantially midway along its length to the ends of the elongated handle.

In another preferred form of the invention, the elongated handle includes at each end an adjustable and lockable pivoting means, being ball and socket or swivel joint member. The cups which are selectively removable are connected with extensions such that the ball and socket member or swivel joint provides a swivel effect. The cups can thereby be set in different selected positions relative to the longitudinal axis of the elongated handle.

In a further form of the invention, the handle ends include a T-piece at each end. The cups, which are selectively removable, can be attached to the T-piece so that the cups could be positioned either axially or transverse relative to the handle longitudinal axis.

In another form of the invention, the handle includes an elbow at each end. The elbow acts to secure the cups with their radial axis transverse to the longitudinal axis of the handle. The handle and gripping element are relatively rotatable about the longitudinal axis thereby facilitating alignment of the cups in the water as the device is moved through the water.

In yet a further preferred form of the invention the cups are selectively removable from the elongated handle. The cups can be connected and located with the handle in multiple modes. In one form, the cups are connected with the handle so that the rims of each opposite cup is directed toward each other and the cups extend over the handle. In another form, the rim of one cup extends over the handle while the rim of a second cup extends longitudinally from the handle. In a further form, the cups are located with the handle so that the rims extend longitudinally away from the elongated handle.

In a further preferred aspect of the invention the cups are flexible and selectively reversible about the base of each cup, such that different relative positions can be adopted for each cup on the handle.

The invention is further described with reference to the accompanying drawings.

DRAWINGS

DESCRIPTION

Figure 1:
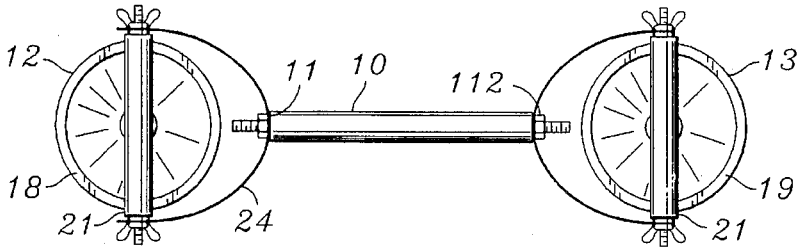
FIG. 1 is a side view of one embodiment of the invention illustrating an elongated handle and a pair of cups. Each cup is located at each respective end of the elongated handle, the cups being in a first position relative to the elongated handle.
Figure 2:
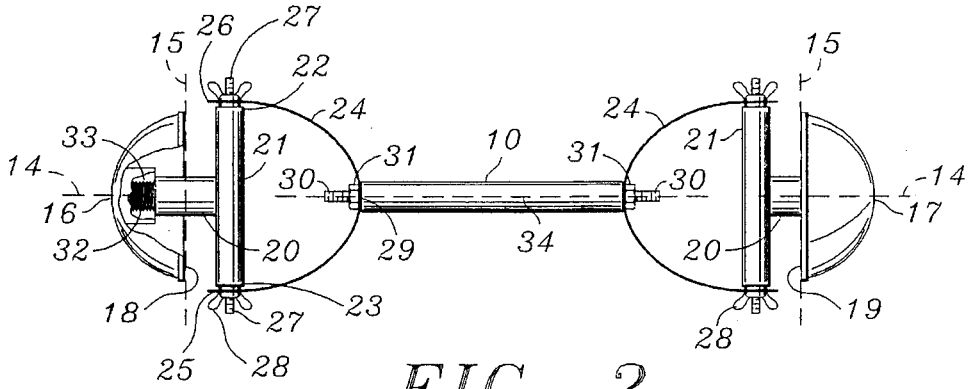
FIG. 2 is a different side view of the device illustrated in FIG. 1. The cups are located relative to the handle in a different position than shown in FIG. 1.

An aquatic exercising device includes an elongated handle 10 with a first end 11 and a second end 112. A first hydroresistive element, namely a first cup 12 is operatively connected with the first end 11 and a second hydroresistive element, namely a second cup 13 is operatively connected with the end 112 of the handle 10. At least one of the cups 12 or 13 is selectively connected in different positions relative to the handle 10.

Cup 12 includes a radial axis 14 and a transverse plane 15. The radial axis extends from the base of the cup towards the center of the cup. A similar axis and plane is provided for cup 13. Each of cups 12 and 13 include a base 16 and 17 respectively and a circumferential rim 18 and 19 respectively. The rims 18 and 19 for each respective cup 12 and 13 are located in substantial alignment with the transverse plane 15, which is perpendicular to the radial axis 14 of the cups 12 and 13.

Aligned with the radial axis 14 is an axial extension or component 20 which joins with a transverse crossbar component 21. The transverse component 21 lies parallel to the transverse plane 15. The transverse component 21 is removed from the plane 15 away from the bases 16 and 17 and the rims 18 and 19. The axial component 20 and crossbar 21 forms an integral T-shaped unit.

Each end 22 and 23 respectively of the transverse crossbar component 21 is connected with a stirrup 24. Stirrup 24 is substantially a semi-circular, U-shaped or elliptical component which has free ends 25 and 26 respectively. The stirrup 24 can be formed of a relative flat elongated plate. The ends 25 and 26 include apertures through which a threaded pin 27 passes axially along the longitudinal axis through transverse crossbar component 21. Butterfly nuts 28 engage on the threaded pin 27 such that the apertures in the end of each stirrup 24 engage with and can be locked with the threaded pin 27. About midway between the ends 25 and 26 of each stirrup 24, there is provided an aperture 29 through which a threaded shank 30 extending longitudinally along and from the handle 10 can pass. A nut 31 affixed to and locked with the shank 30 secures stirrup 24 with the handle 10 as required.

The end of the axial component 20 includes a threaded formation 32 for engaging with an internally threaded axial extension formation 33 which is formed as part of the cups 12 and 13 around the radial axis 14.

By turning each of the cups 12 or 13 about the axis through crossbar 21 and then tightening the butterfly nuts, the cups 12 and 13 can adopt a different transverse position relative to the longitudinal axis 34 passing through the elongated handle 10. Similarly by turning the cups 12 and 13 about the radial axis 14 by radially adjusting the position of the stirrup 24 located on a shank 30, the cups 12 and 13 can lie in different positions relative to the longitudinal axis 34 extending with the elongated handle 10. Together with the ability to adjust the cups 12 and 13 about the crossbar 21, many different positions of each cup 12 and 13 relative to the handle 10 can be achieved.

In another form the stirrup can be rotatable about the shank 30. This is achieved by leaving a relative looseness of the nut 31 on shank 30.

Figure 3:
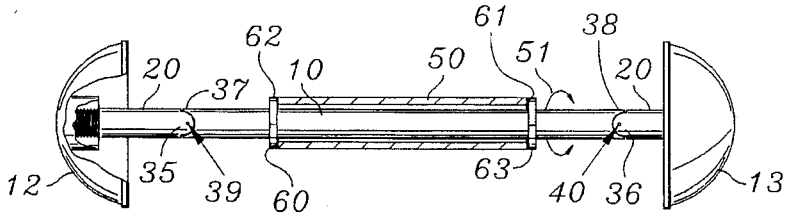
FIG. 3 is a side view of the different embodiment of the device, having a pivoting connection in the elongated handle thereby permitting the cups to adopt a first position.
Figure 4:
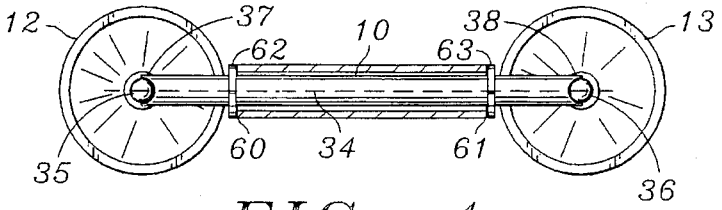
FIG. 4 is a different side view of the embodiment illustrated in FIG. 3 with the cups in a different relative position with the elongated handle.
Figure 5:
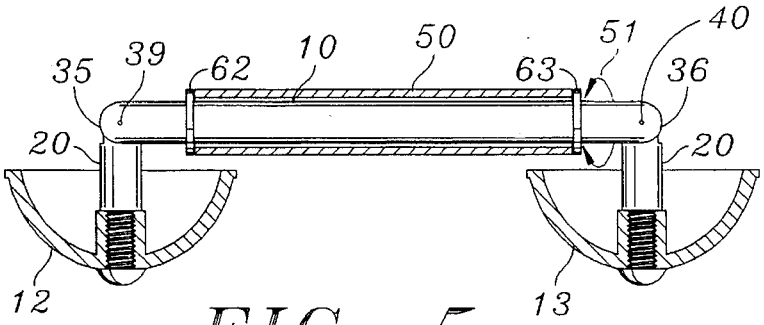
FIG. 5 is a different side view namely turned 90° about the longitudinal axis, of the embodiment illustrated in FIGS. 3 and 4.

In the embodiment illustrated in FIGS. 3, 4 and 5, there are adjustable and lockable ball and socket means or swivel joint 35 and 36 located towards the ends 37 and 38 respectively of the elongated handle 10. One side of the ball and socket means or swivel joint 35 and 36 is connected with the radial axial component 20 which is affixed to each of cups 12 and 13. The other side of the ball and socket means or swivel joint 35 and 36 is affixed to or formed as a part of the ends of the handle 10. In this manner the cups 12 and 13 can swivel to adopt any one of multiple different positions relative to the pivot centers 39 and 40 as defined by the respective ball and socket means or swivel joint 35 and 36 respectively. Suitable friction or locking means ensures that the ball and socket means or swivel joint 35 and 36 can be locked in desired positions. Such locking means can be a screw and bolt mechanism. The transverse plane 15 would be selectively adjustable and different relative to the longitudinal axis 34 through handle 10.

A user can select the cup 12 to be in one position about the center 39, while the cup 13 may be in a different position about the center 40. For instance, the cups 12 or 13 are located in a sideways or perpendicular position relative to the axis 34 as illustrated in FIG. 4 and FIG. 5. Alternatively the cups 12 and 13 may be aligned on the axial extensions relative to the axis 34 further along longitudinal handle 10 as illustrated in FIG. 3.

Also shown in FIGS. 3 through 5 and FIGS. 8 through 13 is a hand gripping element 50 which is in the nature of a tube which fits over the handle 10 to facilitate relative rotation of the handle 10 about the axis 34. With a palm or hand of a user gripping the outside of the element 50, the handle 10 and cups 12 and 13 can turn about the axis 34 as indicated by arrow 51 as the device is moved through the water.

In the embodiment of FIGS. 3 to 5 and FIG. 8 the tube 50 is shown in cross-section, and the ends 60 and 61 of the tube 50 are arranged to abut against upstanding flanges 62 and 63 respectively formed on the surface of the handle 10. These flanges maintain the proper position of the hand gripping element 50. The flanges 62 and 63 and/or the tube 50 are made of a material to permit assembly. As such the material of at least one of the flanges 62 or 63 or component 50 may be flexible or resilient, or selectively rigid.

Figure 6:
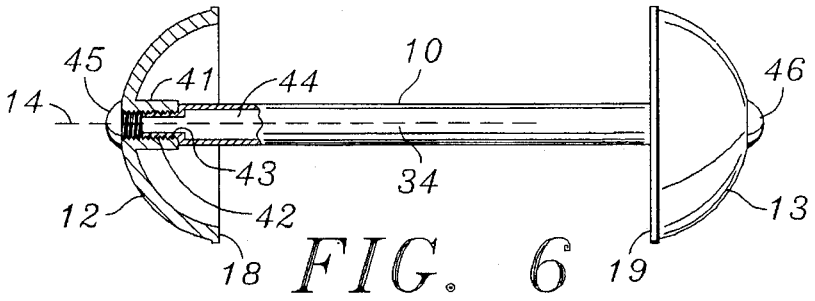
FIG. 6 is a side view partially in cross section of the removable cups with an elongated handle, the cups being directed so that the rims are towards each other.
Figure 7:
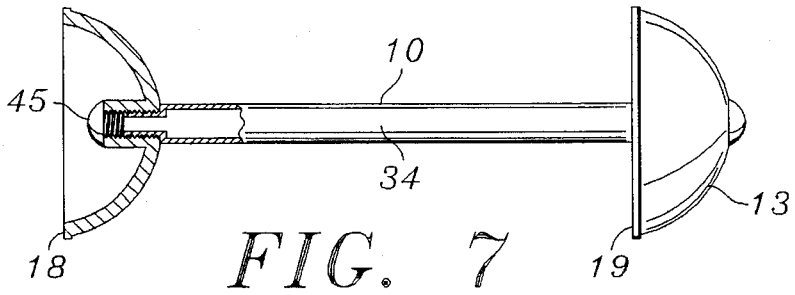
FIG. 7 is a side view partially in cross section showing removable cups, one of the cups being directed partly over the handle, and the second cup being directed with the rim directed away from the handle.
Figure 8:
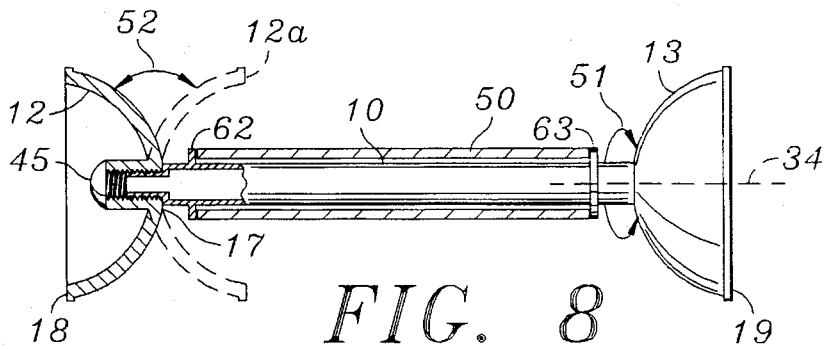
FIG. 8 is a side view partially in cross section with the cups located over the handle, the rims being directed away from the handle.

In a third form of the invention as illustrated in FIGS. 6 to 8, the cups 12 and 13 are removably connected relative to the handle 10. The cups include an axial component 41 which extends along the radial axis 14 for each cup. The radial axis 14 is coincident with the axis 34 of the handle 10. The axial component 41 includes an internal double threaded member 42. The elongated handle 10 includes an externally double threaded member 43. The cups 12 and 13 are suitably threaded into engagement with the handle 10. The handle 10 can be hollow as illustrated in FIGS. 6 to 8. There is a bore 44 which runs axially through the elongated handle 10.

Selectively caps 45 and 46 can be provided to the ends of the bore 44. The bore 44 may be sealed so that there is air in the bore 44. Alternatively, it can be partly or wholly filled with water as required.

As illustrated in FIG. 6, the rim 18 of cup 12 and the rim 19 of cup 13 are directed towards each other and essentially over the handle 10. As illustrated in FIG. 7 the rim 19 is directed in part over the handle 10. Rim 18 extends in a direction removed from the handle 10. In the mode illustrated in FIG. 8 the rim 18 extends from the handle 10 and rim 19 also extends from the handle 10. The rims 18 and 19 thus extend away from the handle 10 in that embodiment.

As shown in FIG. 8, the construction of FIGS. 6 and 7 is further modified. The configuration for having the cups 12 and 13 adopt different positions relative to the handle is affected by having the cups 12 and 13 formed of flexible rubber or plastic material. Each cup 12 or 13 can be located with the respective rims 18 and 19 on opposite sides relative to base 17 as indicated by arrow 52. In this manner, as indicated in phantom by lines 12*a* the cup 12 adopts a reversible position as selected by the user. This flexible cup configuration can be used for the other embodiments of the invention.

Figure 9:
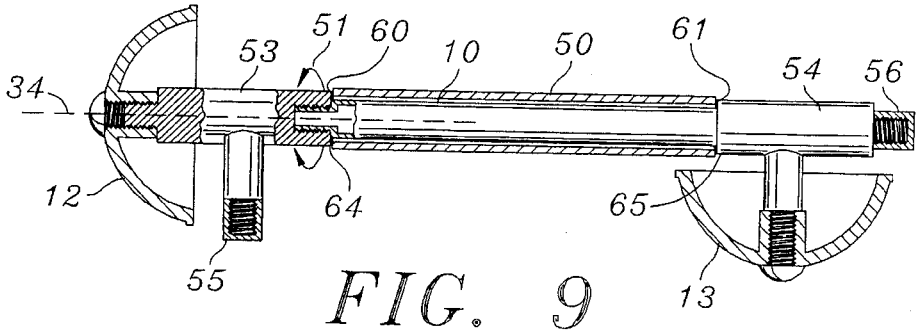
FIG. 9 is a side view of a different embodiment for selectively locating cups in different positions relative to the handle.

In the embodiment of FIG. 9, the handle 10 is affixed at the first end and second end respectively with T-pieces 53 and 54. The handle 10 and T-pieces are relatively rotatable in hand gripping element 50. A cap 55 fits on the base of T-piece 53, and a cap 56 fits on the one free end of the crossbar of T-piece 54. With the T-piece construction 53, cup 12 is fitted at a longitudinal end. With the T-piece 54, the cup 13 is fitted in the base of the T-piece, and the radial axis 14 transverse or perpendicular to the longitudinal axis 34. The ends 60 and 61 of the element 50 abut the ends 64 and 65 respectively of the crossbar of the T-piece.

Figure 10:
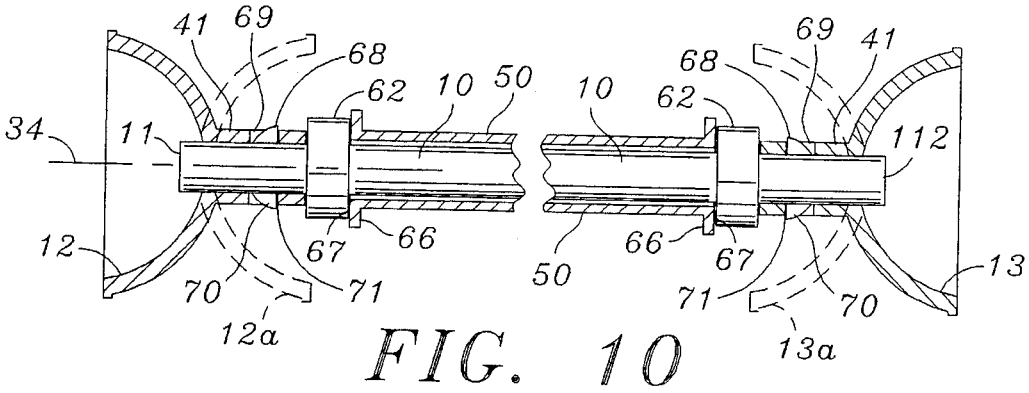
FIG. 10 is a side view partially in cross section of a different embodiment illustrating a handle with a different mechanism for securing the cups to the handle.

In FIG. 10 there is illustrated an embodiment where the handle 10 includes a flange 62. The gripping element 50 includes a radially extending outward lip 66 which interengages with the face 67 of the flange 62. The handle 10 also includes two radially extending pins 68 which facilitate anchorage with the cup 12. Cup 12 includes the axial component 41 and there are two spaced apertures 69 for location with pins 68. Each of the pins 68 has a sloping face 70 and a flat radially extending face 71. This facilitates movement of the axial member 41 onto the pins 68 and prevents retraction of the element 41 from the pins 68. As illustrated in phantom 12*a* the cup can be reversibly located relative to the handle 10 as required.

Figure 11:
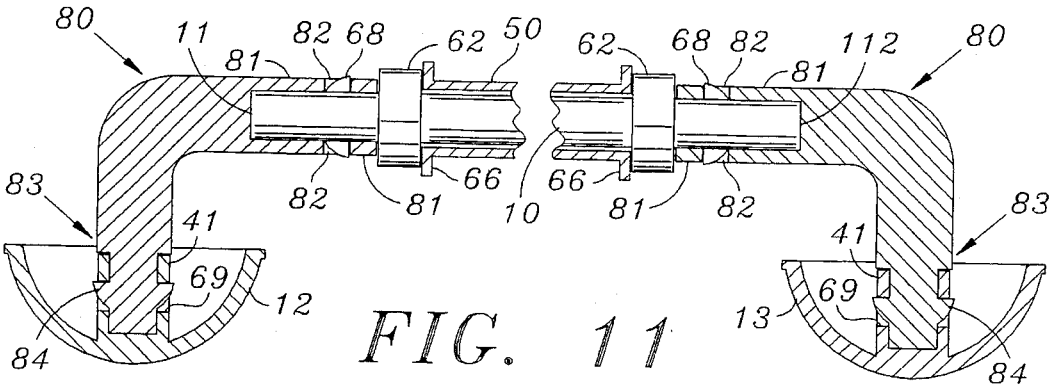
FIG. 11 is a side view partially in cross section showing an elbow connected between the handle and the cups.

In FIG. 11 there is an arrangement of the handle 10 for an outward gripping element 50 having a lip 66 which in turn engages with the flange 62 in the manner illustrated for FIG. 10. On the side of flange 62 remote from the lip 66 there is also an elbow 80 with a partially flexible limb 81 which has radially spaced apertures 82 for engaging with pin 68. Such engagement facilitates anchorage of the elbow 80 with the end of the handle 10. On the opposite end 80 there are a pair of radial pins 84 for engaging with the axial member 41 of cup 12. The aperture 69 in the axial member 41 permits for accommodation of the cup 12 on the end 83 of elbow 80. Elbow 80 is located on both ends of the handle 10 of the device.

Figure 12:
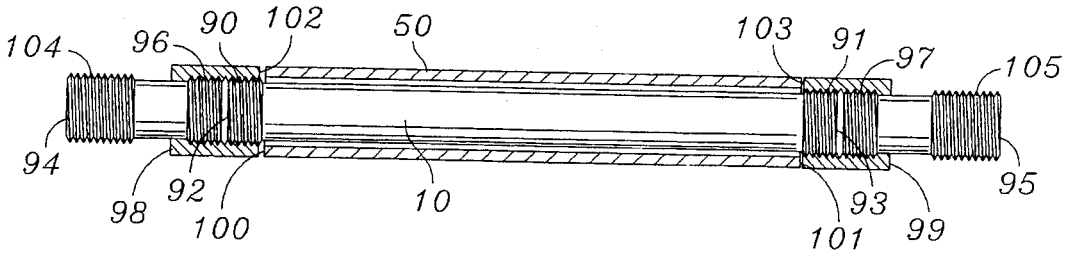
FIG. 12 is a side view partially in cross section showing a different means for connecting the hand gripping element about the handle.

In the arrangement illustrated in FIG. 12 an embodiment is shown for facilitating locking of the hand gripping element 50 with handle 10. In this arrangement the handle 10 includes threaded formations 90 and 91 at the opposite ends 92 and 93 of the handle 10. The tube 50 fits over the handle 10. Located adjacent to the ends 92 and 93 of the handle 10 are separate elements 94 and 95 respectively each having outer threads 96 and 97. Internally threaded couplings 98 and 99 can engage with threads 90 and 96 on the one hand and threads 91 and 97 on the other hand.

Relatively tightening the couplings 98 and 99 so that they move inwardly towards the ends 100 and 101 of the gripping element 50 can selectively permit friction engagement with the ends 102 of coupling 98 and 103 of coupling 99. In this manner the degree of movement and rotation of the hand gripping element 50 relative to the handle 10 can be adjustable and locked if necessary. Thus hand gripping element 50 can be freely rotatable about handle 10. Alternatively, the axial force imparted by the couplings 98 and 99 can create a resistance or locking of the hand gripping element 50 with handle 10. The elements 94 and 95 respectively have threaded portions 104 and 105 at their ends for engagement with cups 12 and 13, or affixing T-pieces or elbows.

Figure 13:
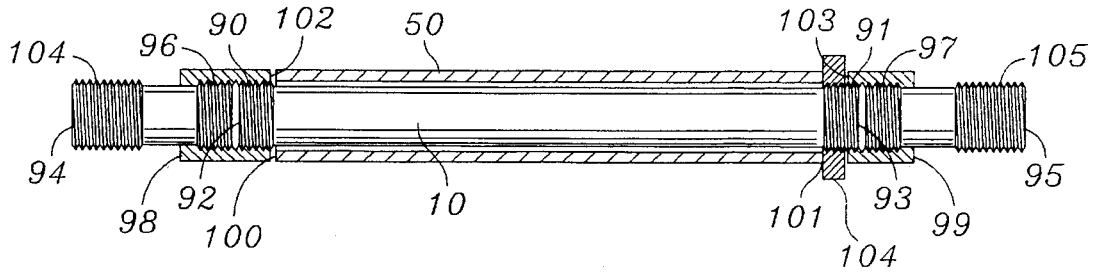
FIG. 13 is a variation of FIG. 12 showing a different means for securing the handle and hand gripping element.

In FIG. 13, the hand gripping element 50 is secured with the handle 10 in a different manner. There is provided an independently operable nut 104 which selectively engages end 101 as required. The nut 104 can be turned without turning coupling 98 or coupling 99. The opposite end 100 of gripping element 50 engages end 102 which can be a non-movable construction with handle 10.

Many other forms of the invention exist, each differing from others in matters of detail only.

For instance, although in FIGS. 6, 7, and 8 the handle 10 is hollow, there can be embodiments where the handle 10 is solid. In other situations, the handle 10 can include internal threads and the axial component 41 could be provided with external threads. This may be in addition to or in place of the threads illustrated in FIG. 6.

Rotation of the stirrups 24 can be effected by having a hand gripping element 50 located over the handle 10. In such a situation the nuts 31 are tightly secured on shanks 30.

The operative connection between the cups and the handle or crossbar axial extension, T-shape, elbow or swivel axial component can be effected in any other suitable way. Instead of threaded engagement a slot and key engagement can be used to affect assembling of the cups with elongated handle in the operative relationship.

In place of the pins 27 and butterfly nuts 28 there can be different locking means. For instance, sliding plates which override each other can leave selected dimples and slots to be step locked in different radial positions relative to the axis through crossbar 21.

In the embodiments illustrated the one cup 12 may be in a different transverse plane relative to the other cup 13 in relation to the longitudinal axis 34. Thus the transverse planes for each of cups 12 and 13 may be differently oriented. The planes may be perpendicular as illustrated or at an angle between axial and transverse.

Although the hydroresistive elements are illustrated as cup-shape, hemispherical or cone shapes, dish shapes and other different hydroresistive shapes including flat panels, or discs with or without perforated elements are possible. Also different sized hydroresistive elements, for instance, in the sense of diameter, can be used as required.

The invention is to be determined solely in terms of the following claims.

I claim:

1. An aquatic exercising device comprising:

a handle having a first end and a second end;

b) a first flexible substantially cup-shaped hydroresistive element operatively connected to the first end of the handle;

c) a second flexible substantially cup-shaped hydroresistive element operatively connected to the second end of the handle; and d) each element including a base, a rim and a first axis extending from the center of the base to the center of an area enclosed by the rim and at least one element being configured to be reversible about an axis perpendicular to said first axis and that intersects with said first axis at the center of the base without being removed from the handle, and including a radial member directed substantially along the first axis for the cup-like shaped hydroresistive element, the radial member having means for permitting removal of the element from the handle and having means for permitting operative connection of the element in opposite positions with a handle end, thereby to permit for exercising within an aquatic environment under respectively different resistive effects.

2. A device as claimed in claim 1 including means for both hydroresistive elements to be selectively connected in different relative positions with the handle.

3. A device as claimed in claim 1 including a hand gripping element operative with the handle wherein each cup-like shaped hydroresistive element is relatively rotatable about a longitudinal axis through the handle.

4. A device as claimed in claim 3 wherein the handle is hollow.

5. An aquatic exercising device as claimed in claim 1 comprising:

means with at least one of the hydroresistive elements for permitting connection of the hydroresistive element in selectively different positions relative to the handle, and including pivoting means located on the handle towards at least one end of the handle, the pivoting means being for securing at least one flexible hydroresistive element member in a selected position relative to the elongated handle.

6. A device as claimed in claim 5 wherein the pivoting means is located on the handle towards each end of the handle, and includes ball and socket means or swivel joint located toward each end of the handle, the ball and socket means or swivel joint being for operative connection with each respective flexible hydroresistive element.

7. A device as claimed in claim 5 wherein the handle is hollow.

8. A device as claimed in claim 5 wherein the handle includes a longitudinal axis, and means with the handle for facilitating relative rotation of the handle about the longitudinal axis.

9. A device as claimed in claim 1 wherein the handle is hollow.

10. A device as claimed in claim 1 wherein the handle includes a longitudinal axis, and means with the handle for facilitating relative rotation of the handle about the longitudinal axis.

11. An aquatic exercising device comprising a handle having a first end and a second end, a first flexible, hydroresistive element operatively connected to the first end of the handle and a second flexible, hydroresistive element operatively connected to the second end of the handle, wherein each element includes a base, a rim and a first axis extending from the center of the base to the center of an area enclosed by the rim and at least one element is configured to be reversible about an axis perpendicular to said first axis and that intersects with said first axis at the center of the base without being removed from the handle, and including a radial member directed substantially along the first axis for the hydroresistive element, the radial member having means for permitting removal of the element from the handle and having means for permitting operative connection of the element in opposite positions with a handle end, thereby to permit for exercising within an aquatic environment under respectively different resistive effects.

* * * * *